United States Patent [19]

Schold

[11] 4,394,981

[45] Jul. 26, 1983

[54] APPARATUS FOR DISPERSING FINELY DIVIDED SOLID PARTICLES IN A LIQUID VEHICLE WITH A MECHANISM FOR REDUCING SCREEN CLOGGING

[76] Inventor: George R. Schold, 8460 Macoma Dr. NE., St. Petersburg, Fla. 33702

[21] Appl. No.: 172,134

[22] Filed: Jul. 25, 1980

[51] Int. Cl.[3] ..... B02C 23/36

[52] U.S. Cl. ..... 241/46.17; 209/302; 241/74; 241/172; 366/194

[58] Field of Search ..... 241/46.04, 46.11, 46.17, 241/74, 79.3, 101 B, 172, 98; 366/184, 194, 195, 196; 209/250, 285, 302

[56] References Cited

U.S. PATENT DOCUMENTS

| | | | |
|---|---|---|---|
| 3,653,600 | 4/1972 | Schold | 241/46.17 X |
| 3,844,490 | 10/1974 | Schold et al. | 241/172 X |
| 4,044,957 | 8/1977 | Schold | 241/74 X |

*Primary Examiner*—Howard N. Goldberg

*Assistant Examiner*—Fred A. Silverberg

*Attorney, Agent, or Firm*—Frank R. Thienpont

[57] ABSTRACT

Apparatus for dispersing solid particles in a liquid vehicle utilizing a separator surrounding an agitating shaft and having a filter screen surrounding the separator and agitator structure disposed in close association with the separator said agitator structure comprising a pair of axially spaced radially extending slinger agitator members and further including agitator bars which extend between the slinger agitator members whereby to prevent dispersing media from clogging the filter screen which forms part of the rotor separator. The apparatus is also provided with a frusto conical construction on the inside of the mixing vessel which is adjacent the rotor separator so that dispersing media coming in contact therewith will be directed back toward the middle of the mixing vessel. In addition provision is made for adjusting the position of the rotor separator on the shaft to adjust the gap in the gap seal.

18 Claims, 3 Drawing Figures

APPARATUS FOR DISPERSING FINELY DIVIDED SOLID PARTICLES IN A LIQUID VEHICLE WITH A MECHANISM FOR REDUCING SCREEN CLOGGING

BACKGROUND OF THE INVENTION

This invention relates to apparatus for uniformly producing finely divided particles and uniformly distributing such finely divided particles in a liquid vehicle.

The invention herein constitutes an improvement to apparatus of the type disclosed in my U.S. Pat. No. 3,653,600 issued Apr. 4, 1972. Units of this type are regularly made in which the mixing vessels have capacities from ½ gallon to 150 gallons. These are enclosed units which operate under pressure and which rely upon pressure to move the processed product through the mill and to the outlet through a rotor separator which incorporates a filtering screen as part of the rotor separator construction. The combination of the dispersing media such as steel shot being used and the pressure generated within the mixing vessel cause the dispersing media to congregate within the area of the rotor separator and its attached screen which are usually positioned in close proximity to the outlet from the vessel. It is important to prevent screen clogging and thus continuing efforts are being made to reduce as much as possible the tendency of the dispersing media to congregate in the area of the screen on the rotor separator. Accordingly it has become appropriate to develop new and improved means to clear the screen area of the rotor separator and reduce the possibility of clogging the screen to make it possible for the processed product to pass more easily from the mixing vessel to the outlet from the mill.

SUMMARY OF THE INVENTION

Accordingly it is a principal object of this invention to provide improved means to prevent clogging of the rotor separator screen and thereby enhance the passage of processed product through the rotor separator.

It is another object of the invention to provide a combination of radially extending and vertically extending agitators in association with the rotor separator to prevent clogging of the rotor separator screen.

Another object of the invention is to provide in association with the rotor separator a simplified cammed arrangement for adjusting the spacing of the gap seal which provides a seal between the rotor separator and the fluid outlet from the mixing vessel.

It is another object of this invention to provide a chamber construction arranged in such a manner that dispersing media will be directed more easily from the area of the rotor separator back into the central portion of the mixing vessel.

Other objects and advantages of this invention will become more apparent when considering the following description and accompanying drawings.

DESCRIPTION OF PREFERRED EMBODIMENT

Figure 2:
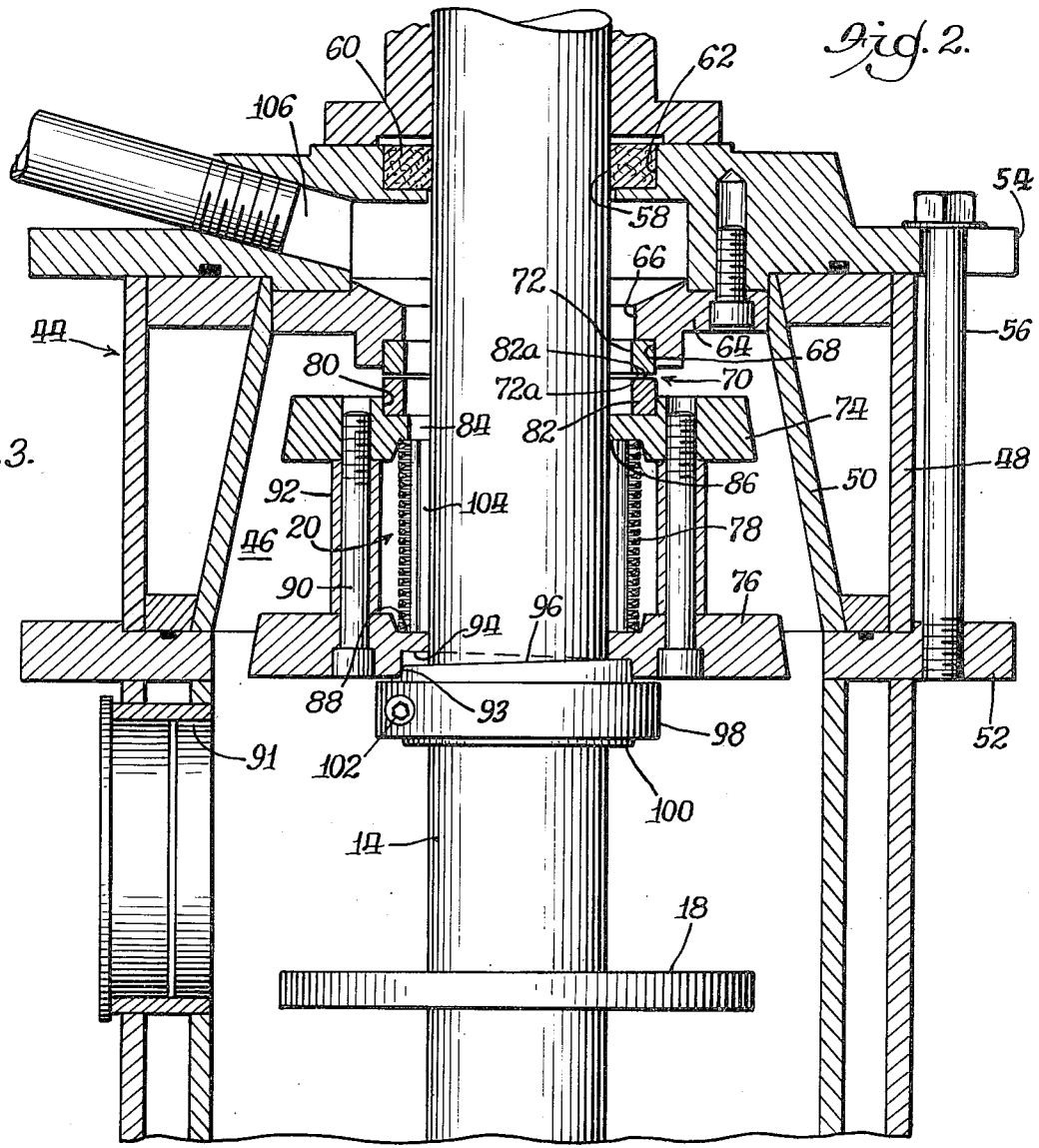
FIG. 2 is an enlarged cutaway sectional view in elevation of the upper portion of the mixing vessel shown in FIG. 1.
Figure 3:
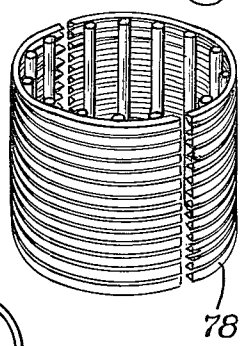
FIG. 3 is a perspective view of a screen element of the type that may be utilized in the apparatus.
Figure 1:
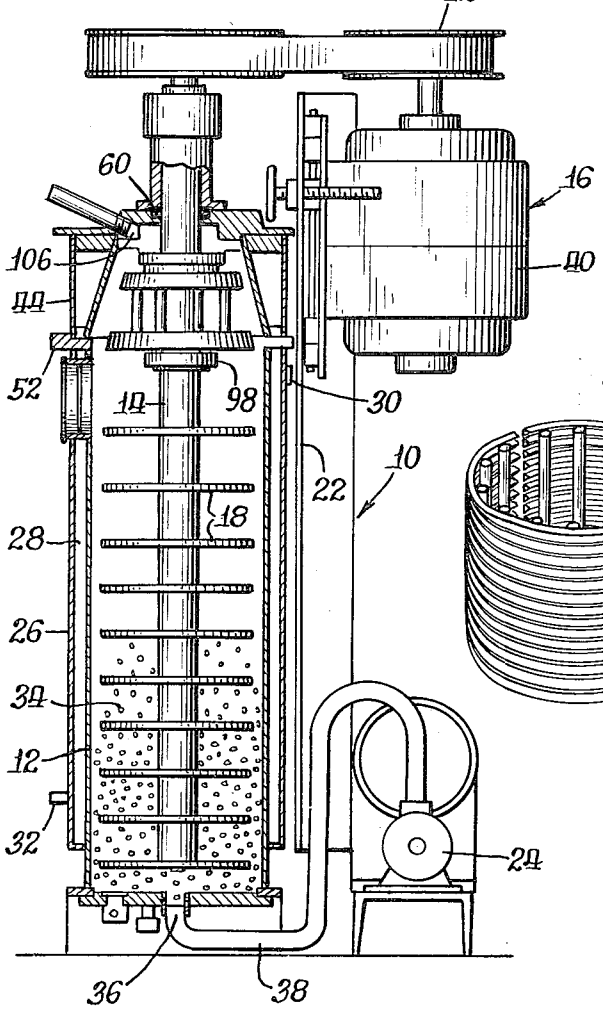
FIG. 1 is a cutaway sectional view in elevation of apparatus embodying the present invention.

We refer now to the drawings wherein like reference characters in the several views designate similar parts. Referring to FIG. 1, 10 designates generally the dispersing apparatus or mill embodying the invention herein. The dispersing apparatus 10 which is substantially like that disclosed in my U.S. Pat. No. 3,653,600 comprises a generally cylindrical vessel 12, a rotatable agitator shaft 14, a drive unit 16 for driving the shaft 14, a plurality of impellers or agitator discs 18 mounted on the shaft 14 and a rotor separator 20 secured to the shaft 14. The vessel 10 and drive unit 16 usually are mounted on a suitable supporting frame 22. A pump 24 is associated with the mill to introduce pre-mixed material into the vessel 12 to be processed. A circumferentially extending jacket 26 is radially spaced from the vessel 12 to form therewith a chamber 28 through which a temperature controlling fluid may be circulated by means of inlet and outlet connections 30 and 32 at the upper and lower parts of the chamber 28.

The vessel is partially filled with a dispersing media 34 such as steel shot, for example, but other types of dispersing media can also be used. When steel shot is used the vessel preferably is filled only about half way.

In the illustrated embodiment the vessel 12 is closed at both its upper and lower ends. An inlet 36 is formed in the lower end of the vessel through which a product to be processed is pumped from pump 24 via conduit 38. An outlet is disposed at the upper end of the vessel.

The drive unit 16 may include a variable speed motor 40 drivingly connected to the shaft 14 by a belt and pulley arrangement 42 and an adjustable control for varying the tension on the belt and pulley arrangement to provide additional shaft speed control.

The upper end of the vessel is formed with a cap or hat portion 44 defining a screen chamber 46. This cap portion 44 comprises an outer cylindrical wall section 48 and an internal conical shaped wall portion 50 defining an inverted frusto conical section which seats on a flange 52 which forms an upper end closure for the chamber 28. A stationary pilot flange 54 is seated on the upper end of the cap portion 44 and may be secured thereto by a plurality of circumferentially spaced bolts 56 which extend between the pilot flange 54 and flange 52. The pilot flange 54 is formed with a central opening 58 through which the shaft 14 extends and a seal member 60 which may be disposed in counterbore 62, surrounds shaft 14 to seal against pressurized fluid leaking out of the mill around the shaft.

An annular seal plate holder 64 is secured to the underside of the stationary pilot flange 54 by bolts or other suitable means. The seal plate holder 64 is formed with an opening 66 through which shaft 14 extends and with a recess 68 on its underside for receiving therein stationary gap seal member 72 of the gap face seal 70.

The rotor separator 20 comprises a pair of annular discs surrounding and attached to shaft 14 and a screen member disposed between the two discs. These disc members extend radially substantially beyond the screen member to form upper and lower annular slinger agitator members 74 and 76. The upper and lower slinger agitators 74 and 76 serve two purposes. They serve first as a support means for holding the screen member 78. It will be observed that these slinger agitator members extend radially outwardly substantially beyond the radial position of the screen member 78. Thus by virtue of their radial extension they also serve as agitator members. The slinger agitator members are effective to reduce the possibility of dispersing media congregating in the vicinity of the screen member to thereby allow processed product to pass more easily through the screen member 78 of the rotor separator.

While the slinger agitators 74 and 76 are here shown as being an integral part of the rotor separator itself it would be possible for the slinger agitators to be separate and distinct from the rotor separator and incorporated in the apparatus as a pair of discs mounted e.g., above and below and closely adjacent to the rotor separator.

The upper slinger agitator 74 is an annular member closely fitted to the agitator shaft and secured thereto by splines or other suitable means. On its upper side the upper slinger agitator member 74 is formed with a recess 80 to hold rotary seal member 82 of the gap face seal 70. This rotary seal member 82 coacts with stationary seal member 72 and is adjustable in association therewith to provide a desired gap preferably of somewhere in the vicinity of 0.003–0.006 inches between the faces 72*a* and 82*a* of the two seal members. The upper slinger agitator 74 also is formed with a plurality of openings 84 about its inner periphery to provide a passageway for processed product which has been forced through the screen 78.

The upper slinger agitator 74 is formed with a recess 86 on its underside for receiving the screen member therein. The lower slinger agitator 76 is formed with a central recess 88 for receiving the lower edge of the screen member 78 therein. Means are provided to secure the screen member between the agitators.

A plurality of bar members extend between the upper and lower slinger agitators. These bar members are intended to act as additional agitating means to further assist in preventing dispersing media from congregating in the vicinity of the screen and thereby prevent clogging of the screen. These bar members may be of various shapes but they are here shown as elongated bolts 90 which interconnect the upper and lower slinger agitators 74 and 76. A plurality of circumferentially spaced bolts are used. The bolts 90 preferably are inserted through the lower slinger agitator 76 and screwed into upper slinger agitator 74. In that position they are easily accessible for servicing operations, and loosening and/or removal of the bolts 90 make it possible to easily remove and install arcuate screen segments comprising the screen member 78 through a hand-hole 91 formed in the wall of the vessel 12. Easily replaceable protective sleeves 92, preferably of stainless steel, may be placed on the bolts 90 to prevent wear on the bolts.

The bolt members 90 are effective to clamp the screen member 78 between the slinger agitators 74 and 76.

The lower side of the lower slinger agitator also is formed with a recess 93 the radially extending surface of which has formed thereon a cam surface 94 designed to coact with a mating cam surface 96 on adjusting ring 98. A retainer snap ring 100 is secured on the shaft 14 to hold the adjusting ring 98 at the desired vertical position on the shaft. The adjusting ring is formed as a split ring and may be secured on the shaft by the bolt 102 or other suitable arrangement.

It is important in apparatus of this type to keep the screen of the rotor separator clean and clear of dispersing media to permit passage of the maximum amount of processed product.

Both the slinger agitators 74 and 76 and the bolt members 90 connecting them are effective to keep the dispersing media moving and thereby reduce the possibility of dispersing media congregating and compacting in the vicinity of the screen member.

The tapered wall portion 50 aids still further in this respect although a straight wall can be used. The tapered wall portion acts as a deflector and is effective to direct downwardly away from the screen member and toward the center of the mill any dispersing media such as steel shot which rises in the mill to the upper portion of the mill.

The screen member 78 which surrounds the shaft 14 is radially spaced from the shaft 14 to define therewith an outlet chamber 104. Thus as processed product is forced through the mill under pressure the product will move through screen 78 radially inwardly into chamber 104, upwardly through openings 84 in the upper slinger agitator 74 and to the outlet 106 from the mill.

The screen 78 may comprise essentially a plurality of spirally wound coils which in their final form comprise wire of a substantially triangular cross-section. The screen 78 preferably is formed in a pair of arcuate segments so that the screen as a whole is easily insertable into and removable from the rotor separator as generally described in my U.S. Pat. No. 3,844,490 issued Oct. 29, 1974. The vertical spacing between the coils may be on the order of 0.010–0.030 inches depending on the size of media used. Vertical bars welded to the inside of the segments of the screen maintain the spacing between the coil edges.

Since the retainer ring 100 limits the downward movement of the adjusting ring 98, it will be apparent that by virtue of the cam surfaces 94 and 96 rotation of the adjusting ring 98 will be effective to control the vertical position of the rotor separator 20 on the shaft and thereby the gap in the gap seal. The gap in the gap seal is controlled so that it is always less than spacing between the coils of the screen 78.

The overall operation of this apparatus should be clearly apparent from the above description and is substantially as described in my U.S. Pat. No. 3,653,600.

With respect to the rotor separator herein described it will be apparent that as processed product is pushed upwardly through the mill and through the rotor separator, the upper and lower slinger agitators 74 and 76 together with the vertical bar agitators 90 will cause substantial agitation of the dispersion media in the vicinity of the screen. These particular agitating means because of their proximity to the screen are particularly effective to keep dispersing media from lingering in the screen vicinity and thus contribute heavily to keeping the screen clear for passage of product.

While a certain preferred embodiment of the invention has been disclosed, it will be appreciated that this is shown by way of example only, and the invention is not to be limited thereto as other variations will be apparent to those skilled in the art and the invention is to be given its fullest possible interpretation within the terms of the following claims.

What is claimed is:

1. Apparatus for deagglomerating and dispersing solid particles held in agglomerated form and carried in suspension in a liquid vehicle by the action of a dispersing media on the solids comprising:

a mixing vessel having a fluid inlet at one end thereof and a fluid outlet at the other end thereof, said vessel being adapted to have a charge of dispersing media introduced thereinto, and said inlet being adapted to be operatively connected to a pump means whereby a fluid mixture may be moved by said pump means under pressure through said inlet and through the dispersing media in said vessel to said fluid outlet;

a rotatable shaft extending into said vessel and adapted to be driven from a power source;

a rotor separator mounted on said shaft for rotation therewith for separating dispersing media from the fluid mixture, said rotor separator being disposed on said shaft near said fluid outlet and in the path of flow between said vessel inlet and said outlet, said rotor separator including a filter screen surrounding and spaced from said shaft;

agitator means disposed in close association with said separator to prevent dispersing media from clogging said filter screen, said agitator means including a pair of axially spaced radially extending slinger agitator members disposed at each end of said screen and surrounding and attached to said shaft to rotate therewith and extending radially outwardly substantially beyond the radial position of said screen, and a plurality of circumferentially spaced elongated agitator bars extending between and connecting said slinger agitator bars, said elongated members being disposed radially outwardly from and spaced from said screen.

2. The apparatus of claim 1 wherein said radially extending slinger agitator members are an integral part of said rotor separator.

3. The apparatus of claim 1 or 2 wherein said elongated agitator bars comprise bolts interconnecting said slinger agitator members.

4. The apparatus of claim 1 or 2 wherein said elongated agitator bars are effective to clamp said screen between said slinger agitator members.

5. The apparatus of claim 1 or 2 including wear sleeves mounted on said elongated agitator bars.

6. The apparatus of claim 1 wherein the interior of said vessel in the vicinity of said rotor separator is constructed in the form of an inverted frusto conical section whereby during operation of said apparatus dispersing media coming in contact with said frusto conical section is directed back toward the middle of said mixing vessel and away from said rotor separator.

7. The apparatus of claims 1 or 2 including gap sealing means associated with said rotor separator and disposed between the rotor separator inlet and vessel outlet whereby all processed product passes through the rotor separator before reaching the vessel outlet.

8. The apparatus of claim 7 including adjusting means associated with said rotor separator for varying the gap in said gap sealing means, said adjusting means including cam means on said rotor separator for moving said rotor separator along said shaft to effect a change in the gap in said gap sealing means.

9. The apparatus of claim 7 including adjusting means associated with said rotor separator for varying the gap in said gap sealing means said adjusting means including a rotatable ring member releasably secured on said shaft adjacent said rotor separator and means defining coacting cam surfaces on said rotatable ring member and said rotor separator whereby rotation of said ring member is effective to move said rotor separator along said shaft to effect a change in the gap in said gap sealing means.

10. Apparatus for deagglomerating and dispersing solid particles held in agglomerated form and carried in suspension in a liquid vehicle by the action of a dispersing media on the solids comprising:

a mixing vessel having a fluid inlet at one end thereof and a fluid outlet at the other end thereof, said vessel being adapted to have a charge of dispersing media introduced thereinto, and said inlet being adapted to be operatively connected to a pump means whereby a fluid mixture may be moved by said pump means under pressure through said inlet and through the dispersing media in said vessel to said fluid outlet;

a rotatable shaft extending into said vessel and adapted to be driven from a power source;

a rotor separator mounted on said shaft for rotation therewith for separating dispersing media from the fluid mixture, said rotor separator being disposed on said shaft near said fluid outlet and in the path of flow between said vessel inlet and said outlet, said rotor separator including a filter screen surrounding and spaced from said shaft;

agitator means disposed in close association with said separator to prevent dispersing media from clogging said filter screen, said agitator means including a plurality of circumferentially spaced substantially axially extending elongated agitator bars disposed radially outwardly from and spaced from said screen, and means secured to said shaft adjacent said screen for supporting said agitator bars.

11. The apparatus of claim 10 wherein said agitator means includes a pair of axially spaced radially extending slinger agitator members disposed at each end of said screen and surrounding and attached to said shaft to rotate therewith and extending radially outwardly substantially beyond the radial position of said screen.

12. The apparatus of claim 11 wherein said radially extending slinger agitator members are an integral part of said rotor separator.

13. The apparatus of claim 11 wherein said elongated agitator bars comprise bolts interconnecting said slinger agitator members.

14. The apparatus of claim 11 wherein said elongated agitator bars are effective to clamp said screen between said slinger agitator members.

15. The apparatus of claim 10 wherein the interior of said vessel in the vicinity of said rotor separator is constructed in the form of an inverted frusto conical section whereby during operation of said apparatus dispersing media coming in contact with said frusto conical section is directed back toward the middle of said mixing vessel and away from said rotor separator.

16. The apparatus of claim 10 including gap sealing means associated with said rotor separator and disposed between the rotor separator inlet and vessel outlet whereby all processed product passes through the rotor separator before reaching the vessel outlet.

17. The apparatus of claim 16 including adjusting means associated with said rotor separator for varying the gap in said gap sealing means, said adjusting means including cam means on said rotor separator for moving said rotor separator along said shaft to effect a change in the gap in said gap sealing means.

18. The apparatus of claim 16 including adjusting means associated with said rotor separator for varying the gap in said gap sealing means, said adjusting means including a rotatable ring member releasably secured on said shaft adjacent said rotor separator and means defining coacting cam surfaces on said rotatable ring member and said rotor separator whereby rotation of said ring member is effective to move said rotor separator along said shaft to effect a change in the gap in said gap sealing means.

* * * * *